US008630429B2

(12) United States Patent
Daley

(10) Patent No.: US 8,630,429 B2
(45) Date of Patent: Jan. 14, 2014

(54) PREVENTING ELECTROSTATIC PULL-IN IN CAPACITIVE DEVICES

(75) Inventor: Michael J. Daley, Canonsburg, PA (US)

(73) Assignee: Robert Bosch GmbH, Stuttgart (DE)

( * ) Notice: Subject to any disclaimer, the term of this patent is extended or adjusted under 35 U.S.C. 154(b) by 55 days.

(21) Appl. No.: 13/328,720

(22) Filed: Dec. 16, 2011

(65) Prior Publication Data

US 2013/0156234 A1 Jun. 20, 2013

(51) Int. Cl.
*H04R 3/00* (2006.01)

(52) U.S. Cl.
USPC ..... 381/111; 381/150; 381/174; 381/369

(58) Field of Classification Search
USPC ..... 381/111, 113, 150, 174, 369
See application file for complete search history.

(56) References Cited

U.S. PATENT DOCUMENTS

| | | | | |
|---|---|---|---|---|
| 6,328,696 | B1 | 12/2001 | Fraser | |
| 7,548,626 | B2 | 6/2009 | Stenberg et al. | |
| 8,134,375 | B2 * | 3/2012 | Boom | 324/679 |
| 2006/0062406 | A1 | 3/2006 | Kinoshita | |
| 2006/0147061 | A1 | 7/2006 | Niwa et al. | |
| 2008/0075306 | A1 | 3/2008 | Poulsen et al. | |
| 2010/0013501 | A1 | 1/2010 | Van Den Boom | |
| 2010/0166228 | A1 * | 7/2010 | Steele et al. | 381/113 |
| 2011/0084759 | A1 | 4/2011 | Bennett et al. | |
| 2011/0110536 | A1 * | 5/2011 | Hovesten et al. | 381/111 |
| 2012/0104898 | A1 * | 5/2012 | Qu et al. | 310/319 |

FOREIGN PATENT DOCUMENTS

| | | |
|---|---|---|
| DE | 102008022588 | 11/2008 |
| GB | 2459864 | 11/2009 |

OTHER PUBLICATIONS

International Search Report and Written Opinion for Application No. PCT/US2012/068721 dated Mar. 27, 2012 (10 pages).

* cited by examiner

*Primary Examiner* — Brian Ensey
*Assistant Examiner* — Sabrina Diaz
(74) *Attorney, Agent, or Firm* — Michael Best & Friedrich LLP

(57) ABSTRACT

A microphone system including an audio sensor with a first electrode and a second electrode. A voltage source is coupled to the first electrode and the second electrode. A high-impedance bias network is coupled between the voltage source and the first electrode of the audio sensor. Additional electronics operate based on a state of the first electrode of the electromechanical device. A feedback system is configured to maintain an electrical potential across the high-impedance bias network at approximately zero volts. Maintaining the electrical potential across the high-impedance bias network at approximately zero volts reduces the tendency of electrostatic pull-in occurring.

14 Claims, 3 Drawing Sheets

PREVENTING ELECTROSTATIC PULL-IN IN CAPACITIVE DEVICES

BACKGROUND

The present invention relates to monitoring and control of capacitive devices in electromechanical systems such as, for example, microphones. Some electromechanical systems, such as non-electret capacitive microphones, include a bias voltage source to apply a near-constant charge under normal operating conditions. However, if the electrodes of such a system come into close proximity with each other, it is possible for charge to flow to or from one or more electrodes. This charge flow can cause one electrode to be physically pulled close to the other resulting in a change in the operating behavior of the device. This phenomenon is called electrostatic pull-in. Some existing systems account for electrostatic pull-in by reducing the sensitivity of the system. Other existing systems detect when electrostatic pull-in is about to occur, or has occurred, and only then adjust the voltage or sensitivity of the device in order to prevent or recover from a collapse event.

SUMMARY

Among other things, the present invention prevents excess charge from flowing onto or off of the electrodes in the system regardless of the relative position of the electrodes by adjusting the electrical potential across a biasing network to equal zero volts. Because the electrical potential across the biasing network is constantly maintained at approximately zero, the tendency for the system to experience pull-in is reduced. Therefore, there is no need to adjust the sensitivity or bias voltage of the system to recover from a detected or anticipated pull-in event. As such, the system is able to provide greater sensitivity at all times during operation of the device.

In one embodiment, the invention provides an electromechanical system, such as a microphone system, including an electromechanical device, such as an audio sensor, with a first electrode and a second electrode. A voltage source is coupled to the first electrode and the second electrode. A high-impedance bias network is coupled between the voltage source and the first electrode of the electromechanical device. Additional electronics operate based on a state of the first electrode of the electromechanical device. A feedback system is configured to maintain an electrical potential across the high-impedance bias network at approximately zero volts.

The electromechanical device includes a capacitive device such as a capacitive microphone. The additional electronics monitor the voltage of the microphone and transmit an electrical signal indicative of changes in the voltage of the microphone. The system may also include a charge pump positioned between the voltage source and the high-impedance bias network. The charge pump adjusts the voltage from the source to a target voltage provided to the high-impedance bias network.

In some embodiments, the feedback system provides an input to the voltage source thereby altering the voltage provided by the voltage source such that the electrical potential across the high-impedance bias network equals approximately zero. In other embodiments, the feedback system provides an input to the charge pump thereby altering the output voltage of the charge pump such that the electrical potential across the high-impedance bias network equals approximately zero. In still other embodiments, the feedback system alters the voltage output from the charge pump such that the electrical potential across the high-impedance bias network equals approximately zero.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
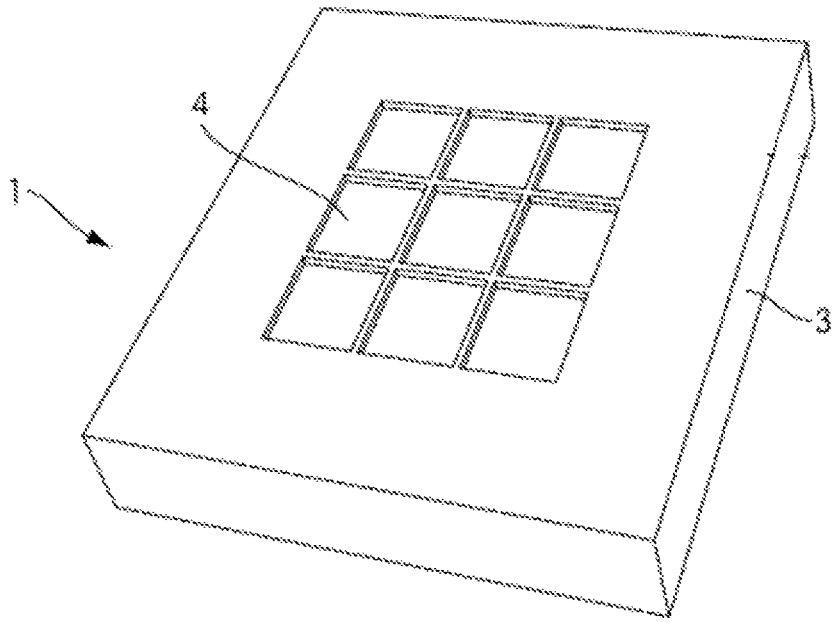
FIG. 1A is a perspective view of a top surface of a microphone according to one embodiment of the invention.
Figure 1B:
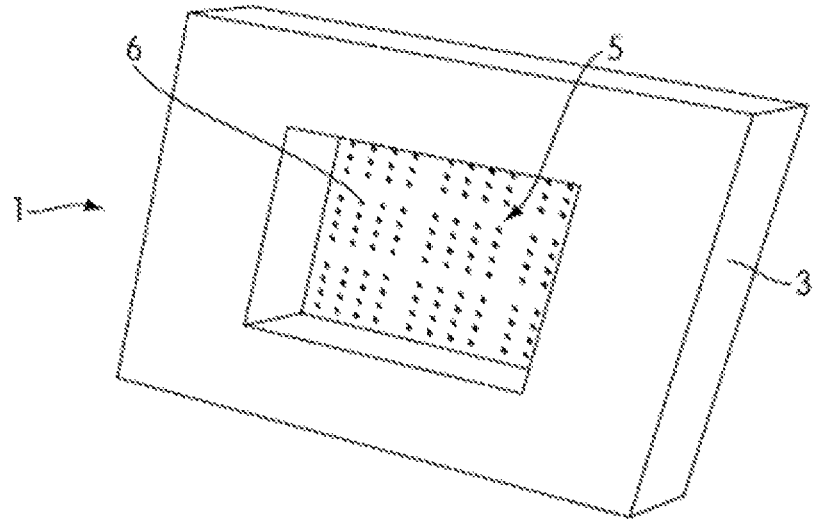
FIG. 1B is a perspective view of the bottom surface of the microphone of FIG. 1A.

FIG. 1A shows the top surface of a CMOS-MEMS microphone 1. The microphone 1 includes a diaphragm or an array of diaphragms 4 supported by a support structure 3. The support structure is made of silicon or other material. As shown in FIG. 1B, the back side of the microphone structure 1 includes a back cavity 5 etched into the silicon support structure 3. At the top of the back cavity 5 is a back plate 6.

Figure 2:
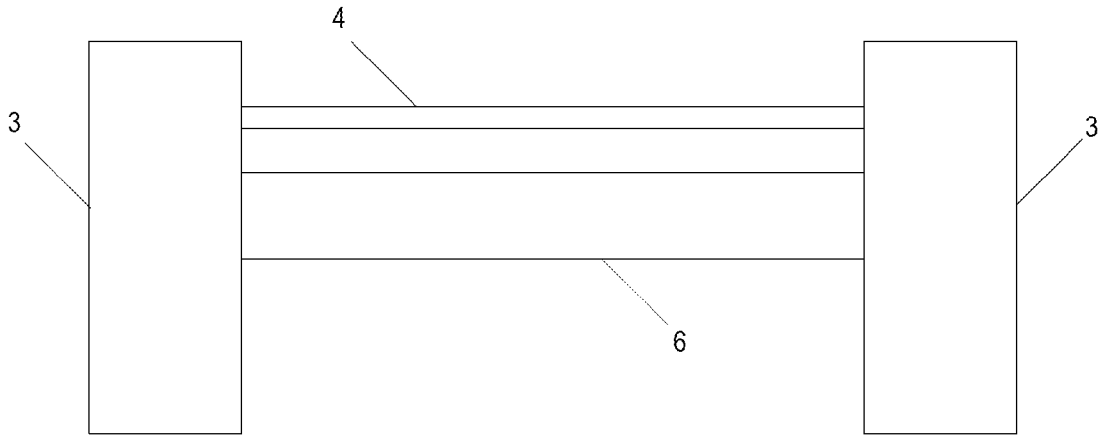
FIG. 2 is a cross-sectional view of the microphone of FIG. 1A.

FIG. 2 is a cross-sectional illustration of the microphone structure 1 from Figs. IA and 1B. As shown in FIG. 2, the back-plate 6 and the diaphragm 4 are both supported by the silicon support structure 3. However, in some embodiments, the support structure may include multiple layers of different material. For example, CMOS layers may be deposited on top of the silicon support structure 3. In some embodiments, the diaphragm 4 is supported by the CMOS layers instead of being directly coupled to the silicon support structure 3.

The diaphragm 4 and the back-plate 6 are positioned so that a gap exists between the two structures. In this arrangement, the diaphragm 4 and the back-plate 6 act as a capacitor. When acoustic pressures (e.g., sound) are applied to the diaphragm 4, the diaphragm 4 will vibrate while the back-plate 6 remains stationary relative to the silicon support structure 3. As the diaphragm 4 moves, the capacitance between the diaphragm 4 and the back-plate 6 will also change. By this arrangement, the diaphragm 4 and the back-plate 6 act as an audio sensor for detecting and quantifying acoustic pressures.

Figure 3:
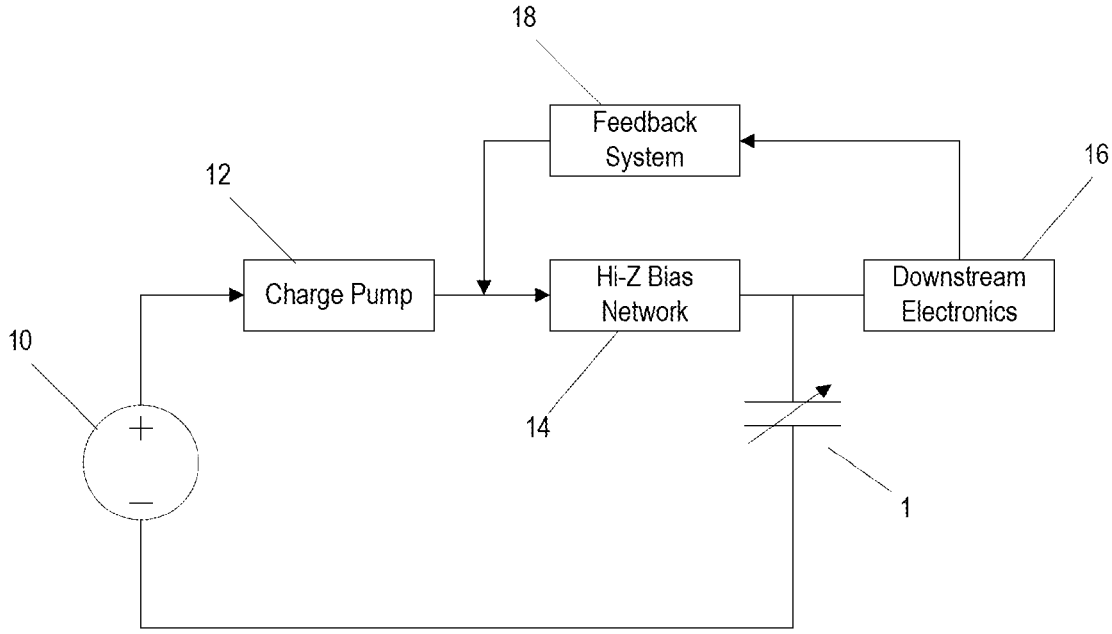
FIG. 3 is a schematic diagram of a control system for the microphone of FIG. 1A.

FIG. 3 is a schematic illustration of a control system that is used to detect the changes in capacitance between the diaphragm 4 and the back-plate 6 and output a signal representing the acoustic pressures (e.g., sound) applied to the diaphragm 4. In order to detect the capacitance charge, a biasing charge is placed on the diaphragm 4 relative to the back-plate 6. A voltage source 10 provides an input voltage to a charge pump 12. The output of charge pump 12 provides a voltage to the input of a high-impedance bias network 14. The voltage source 10, the charge pump 12, and the high-impedance bias network 14 are connected in a series-type arrangement. In this series-type arrangement, additional devices can be connected in series or parallel with one or more of the voltage source 10, the charge pump 12, and the high-impedance bias network 14.

The high-impedance bias network applies an electrical bias to the microphone 1. This arrangement provides a near-constant charge on the microphone 1. Additional downstream electronic devices 16 monitor changes in the voltage on the electrodes of the microphone element 1. The downstream electronic devices 16 include a signal processing system that generates and communicates an output signal indicative of detected acoustic pressures based on the changes in the capacitance of the microphone element 1.

In previous biased microphone systems, if the acoustic pressures caused the diaphragm to move too close to the back-plate, the voltage across the microphone element would change. This would cause a non-zero voltage to develop across the high-impedance bias network. As such, charge would flow across the high-impedance bias network. The flow of charge would cause an increase in the electrical attraction between the diaphragm and the back-plate of the microphone element. This increased attraction would result in electrostatic pull-in and could adversely affect the operation of the microphone system.

To prevent electrostatic pull-in, the system illustrated in FIG. 3 includes a feedback system 18. The feedback system 18 operates to maintain an electrical potential of approximately zero volts across the high-impedance bias network 14. The feedback system 18 generates a feedback signal based on the voltage difference between the microphone element 1 and the charge pump voltages. The feedback signal adjusts the input to the high-impedance bias network 14 accordingly to ensure that the electrical potential remains at or approaches zero volts. For example, in some constructions, the feedback system 18 buffers and applies a gain to an output signal of the downstream electronics 16 and couples that buffered output back to the input of the high impedance bias network 14. As such, any time varying component of the output is equally applied to the input side of the high impedance bias network 14, thereby, resulting in approximately zero volts across the high impedance bias network 14 during high amplitude transient signal swings and no charge transfer across the bias network due to such event. By maintaining a zero-volt electrical potential across the high-impedance bias network 14, no charge flows across the high-impedance bias network 14. This reduces the tendency for the diaphragm 4 to pull in to the back-plate 6.

In the system illustrated in FIG. 3, the feedback signal from the feedback system 18 acts on the output from the charge pump 12. Depending upon the monitored performance of the microphone 1, the feedback signal may, for example, couple an audio-band AC signal onto the charge pump output equal to the signal on the microphone element 1. As such, the feedback system directly increases or decreases the voltage or current provided to the high-impedance bias network 14 in such a way to ensure that the electrical potential is approximately zero volts.

Figure 4:
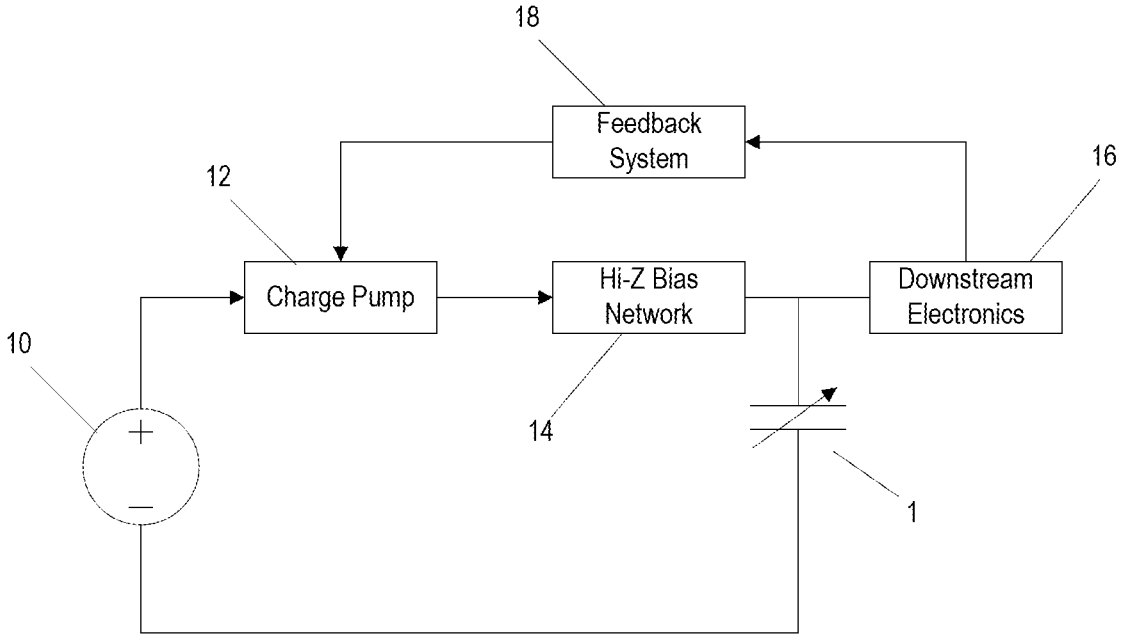
FIG. 4 is a schematic diagram of an alternative control system for the microphone of FIG. 1A.

FIG. 4 illustrates an alternative arrangement. In FIG. 4, the feedback system 18 provides an input signal directly to the charge pump 12 to alter the operation of the charge pump 12. As a result, the output from the charge pump 12 is already adjusted so that the charge provided to the high-impedance bias network 14 results in a zero volt electrical potential.

Figure 5:
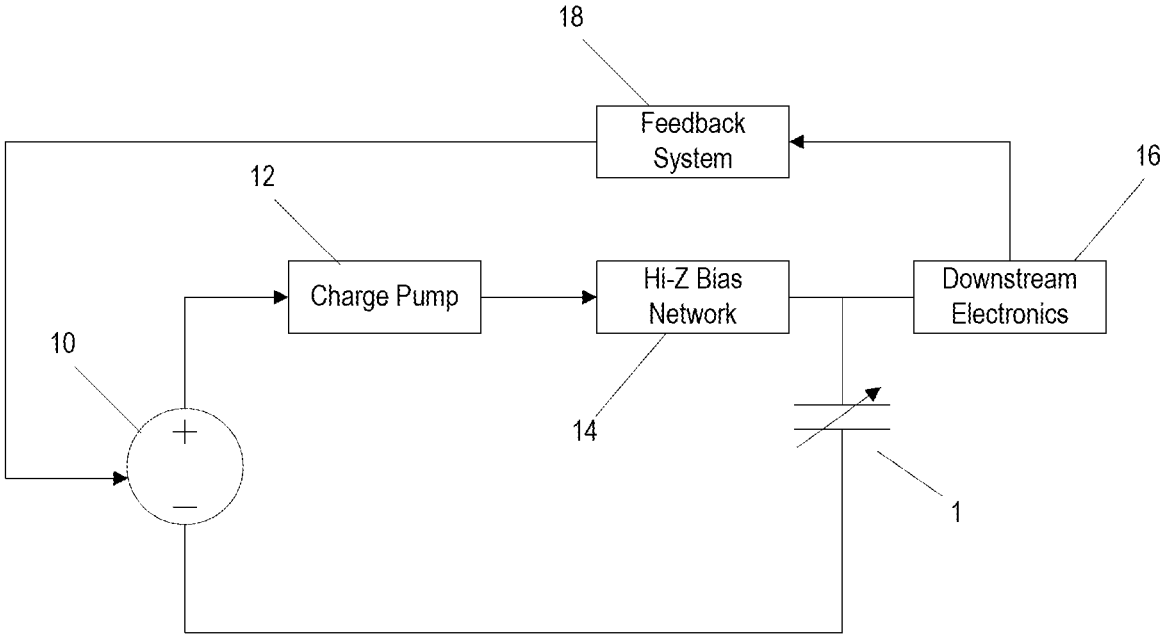
FIG. 5 is a schematic diagram of another alternative control system for the microphone of FIG. 1A.

FIG. 5 illustrates another alternative arrangement. In the system of FIG. 5, the feedback system 18 provides an input signal directly to the voltage source 10 to alter the operation of the voltage source 10. As a result, the output from the voltage source 10 is already adjusted in such a way that the output from the charge pump 12 results in a zero volt electrical potential across the high-impedance bias network 14.

Thus, the invention provides, among other things, a microphone system that prevents electrostatic pull-in by maintaining an electrical potential of zero volts across and no charge-flow through a high-impedance bias network that provides a bias voltage to the microphone. Various features and advantages of the invention are set forth in the following claims.

What is claimed is:

1. A microphone system comprising:

an audio sensor including a first electrode and a second electrode;

a voltage source coupled to the first electrode and the second electrode of the audio sensor;

a high-impedance bias network coupled between the voltage source and the first electrode, the high-impedance bias network receiving an input voltage from the voltage source and providing a biasing voltage output to the first electrode;

one or more additional electronic devices that operate based on a state of the first electrode; and a feedback system configured to maintain an electrical potential across the high-impedance bias network at approximately zero volts.

2. The microphone system of claim 1, wherein the audio sensor includes a capacitive device and wherein the one or more additional electronic devices operate based on a voltage on the capacitive device.

3. The microphone system of claim 1, wherein the feedback system provides an input to the voltage source and wherein the input to the voltage source alters a voltage provided by the voltage source such that the electrical potential across the high-impedance bias network equals approximately zero volts.

4. The microphone system of claim 1, further comprising a charge pump positioned in a series-type arrangement between the voltage source and the high-impedance bias network.

5. The microphone system of claim 4, wherein the feedback system provides an input to the charge pump and wherein the input to the charge pump alters a voltage provided by the charge pump such that the electrical potential across the high-impedance bias network equals approximately zero.

6. The microphone system of claim 4, wherein the feedback system alters a voltage provided by the charge pump such that the electrical potential across the high-impedance bias network equals approximately zero.

7. The microphone system of claim 1, wherein the first electrode includes a diaphragm of the microphone, and wherein the second electrode includes a back-plate of the microphone.

8. The microphone system of claim 1, wherein acoustic pressures exerted on the audio sensor cause a change in a voltage on the first electrode, and wherein the feedback system is configured to maintain the electrical potential across the high-impedance bias network at approximately zero volts by monitoring the voltage on the first electrode, and adjusting the input voltage provided to the high-impedance bias network based on the monitored voltage on the first electrode.

9. A method of preventing electrostatic pull-in in a capacitive microphone, the microphone including a voltage source coupled to a first electrode and a second electrode of the capacitive microphone and a high-impedance bias network coupled between the voltage source and the first electrode, the method comprising:

providing a biasing voltage from the high-impedance bias network to the first electrode of the microphone;

monitoring a voltage on the first electrode; and maintaining an electrical potential across the high-impedance bias network at approximately zero volts.

10. The method of claim 9, wherein maintaining an electrical potential across the high-impedance bias network at approximately zero volts includes providing an input to the voltage source and altering a voltage provided by the voltage source based on the input such that the electrical potential across the high-impedance bias network equals approximately zero volts.

11. The method of claim 9, further comprising receiving a first voltage from the voltage source at a charge pump and providing a second voltage from the charge pump to the high-impedance bias network.

12. The method of claim 11, wherein maintaining an electrical potential across the high-impedance bias network at approximately zero volts includes providing an input to the charge pump and altering, by the charge pump, the second voltage based on the input, such that the electrical potential across the high-impedance bias network equals approximately zero volts.

13. The method of claim 11, wherein maintaining an electrical potential across the high-impedance bias network at approximately zero volts includes altering a second voltage provided by the charge pump such that the electrical potential across the high-impedance bias network equals approximately zero volts.

14. The method of claim 9, wherein acoustic pressures applied to the microphone causes a change in the voltage on the first electrode, and wherein the act of maintaining the electrical potential across the high-impedance bias network at approximately zero volts includes adjusting the input voltage provided to the high-impedance bias network based on the monitored voltage on the first electrode.

* * * * *